United States Patent [19]

Meyer

[11] Patent Number: 4,541,866

[45] Date of Patent: Sep. 17, 1985

[54] HOT INJECTION LADLE METALLURGY

[75] Inventor: Thomas N. Meyer, Murrysville, Pa.

[73] Assignee: Westinghouse Electric Corp., Pittsburgh, Pa.

[21] Appl. No.: 574,306

[22] Filed: Jan. 26, 1984

[51] Int. Cl.[4] ..... C21C 7/02

[52] U.S. Cl. ..... 75/53; 75/10 R; 75/58; 266/216; 266/217

[58] Field of Search ..... 266/216, 217; 75/53, 75/58, 10 R, 129

[56] References Cited

U.S. PATENT DOCUMENTS

| | | | |
|---|---|---|---|
| 3,497,196 | 2/1970 | Ruttiger | 266/216 |
| 4,169,724 | 10/1979 | Freissmuth | 75/53 |
| 4,342,590 | 8/1982 | Luyckx | 75/58 |
| 4,357,160 | 11/1982 | von Bogdandy | 75/60 |

*Primary Examiner*—Peter D. Rosenberg
*Attorney, Agent, or Firm*—John Victor Pezdek

[57] ABSTRACT

A method of preheating a ladle addition to a melt contained in an enclosed or covered ladle without significant loss of melt temperature. A gas stream is heated in a non-transferred arc electric arc heater to a temperature in excess of that of the melt. The ladle addition is introduced into the heated gas stream in the arc heater downstream of the arc heater wherein its temperature is increased to be about equal to or greater than the melt temperature. The heated gas stream and the entrained ladle addition is then introduced into the ladle. As the gas stream impinges on the melt, the ladle addition separates out and combines with the melt with the resulting off-gas being exhausted from the ladle. The off-gas can be recycled to the arc heater for reuse.

15 Claims, 1 Drawing Figure

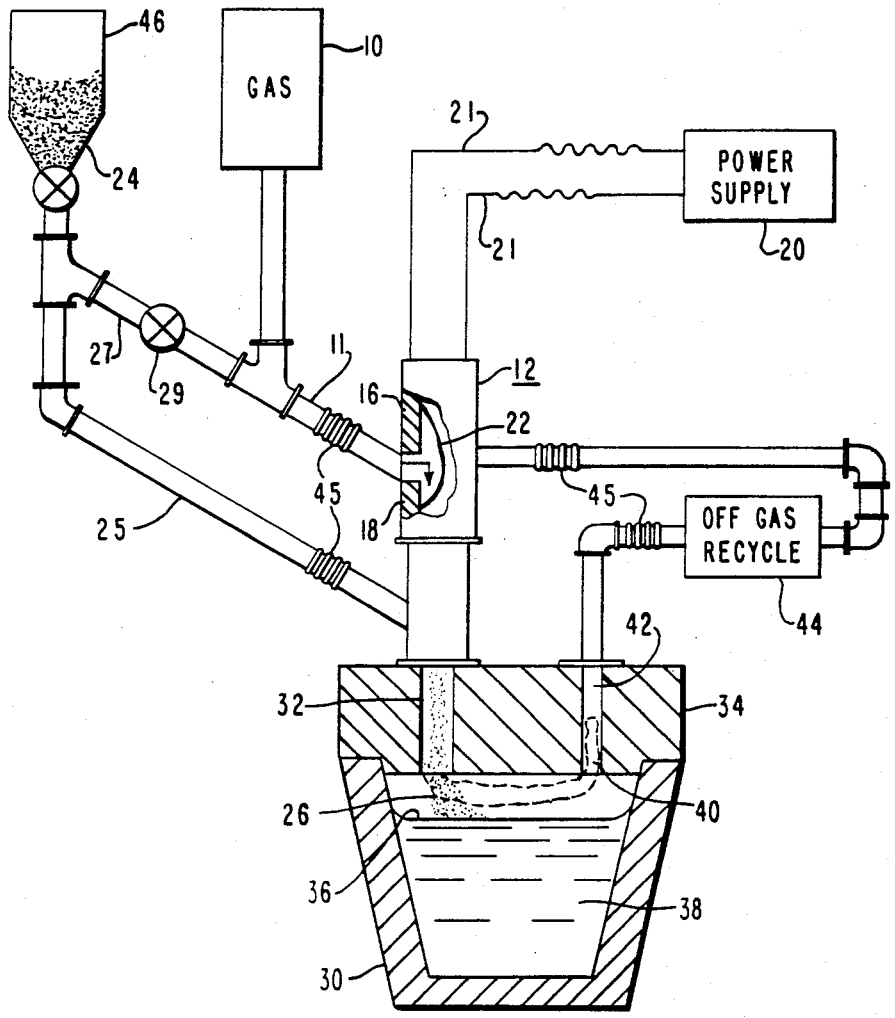
46
GAS
10
21
POWER SUPPLY
24
21
20
27
29
11
12
16
22
45
45
25
18
OFF GAS RECYCLE
44
42
32
34
26
40
36
38
30

HOT INJECTION LADLE METALLURGY

BACKGROUND OF THE INVENTION

The invention relates to a method of preheating ladle additions prior to their addition to a melt contained in a ladle. In particular, the preheating of the ladle addition is accomplished by the use of non-transferred electric arc heaters.

In the steel industry, adjustments in the metallurgical composition of the hot metal is increasingly being done in the ladle. The chemistry of the metal is sampled and the necessary adjustments made while in the ladle prior to pouring. Unfortunately, the ladle addition such as alloying materials, gas and other material additions to the melt decrease the melt temperature. To have proper pouring temperature, the hot metal and the ladle is generally superheated to a level above the pouring temperature to compensate for temperature losses associated with the materials being added, cold gas stirring of the bath, and ordinary heat losses to the ambient. One of the principal causes of the temperature drop is the addition of cold lime to the bath for slaging and desulfurization.

In order to avoid the temperature reduction problem associated with ladle additions, three basic approaches have been followed. The first of these is the use of addition materials which will produce exothermic chemical reactions when added to the melt. Examples of this practice can be found in U.S. Pat. No. 4,169,724, issued Oct. 2, 1979 and entitled "Desulfurization of Iron Melts", U.S. Pat. No. 4,342,590, issued Aug. 3, 1982, entitled "Exothermic Steel Ladle Desulfurizer and Methods for its Use", and U.S. Pat. No. 4,357,160, issued Nov. 2, 1982, entitled "Process for Improving the Use of Heat in Steel Production From Solid Iron Material". One disadvantage with these methods is that at least one of the materials to be added must create the exothermic reaction. Also, undesirable reaction by-products may be produced which could result in contamination of the melt.

The second approach to maintaining melt temperature during material addition is the use of combustion burner systems in which the melt additions are directly heated by the combustion flames or by gases which are heated by the combustion flames. However, combustion flames are very inefficient heat transfer devices at typical melt temperatures. The flame temperature (i.e. 2200° C.) is usually only slightly higher than the melt temperature (i.e. 1600° C.). 2000° C. Also, combustion burners typically have oxidizing flames that create oxides of the material being added which places oxygen in the melt. This can result in lower product yields and possible contamination of the melt due to the presence of oxygen or the oxides. Where indirect heating with gas occurs, similar inefficiencies take place. Also, the off-gases that are produced in the ladle are usually at the temperature of the melt. In order to improve operating efficiency, heat recuperation systems are used to recover the energy contained in the off-gases which are exhausted by the ladle.

In comparison to an electric arc heater, large volumes of gas must be heated with the combustion burners in order to transfer the equivalent amount of energy into the added material and ladle. For an air/natural gas combustion system, several times the volume of heated gas is required to transfer the same heat energy that is present in an electric arc heated gas stream. For a combustion system, the size of the recuperation system and pollution control systems which are used to process the off-gases is significantly larger than is required for an electric arc heater. With the combustion system, large volumes of gas are coming in contact with the melt. Because the gas is oxidative and soluble in the melt, this can result in contamination of the metal.

With most additions of material to the melt, the form of the material that is added is usually finely-divided, pulverized or in a powder form. When these materials are heated by the combustion gases, problems arise in the ladle with separating the heated materials from the large volume of combustion gases involved. Additionally, carryover of the added materials with the exhausted off-gases can also occur reducing the amount of material available to combine with the melt as well as adding additional pollutants to the exhausted off-gases.

It would be advantageous therefore to have a method of preheating ladle addition materials that uses a reduced volume of gas as well as providing more effective control of material deposition on the melt.

The third approach has been the use of transferred arc type arc heater to provide the thermal energy directly to the melt. The arc is struck between the electrode and the melt contained in the ladle. Although the thermal energy of the arc is directly transferred to the melt, splashing of the melt, caused by various factors including the arc, onto the electrode interferes with the operation of the arc heater and can damage the electrode. A method where the heating efficiency of the electric arc heater can be retained while substantially reducing the possibility of melt splash onto the electrodes would be beneficial.

SUMMARY OF THE INVENTION

The present inventiion is a method of preheating a ladle addition to a melt contained in an enclosed ladle or covered without significant loss of melt temperature. A gas stream is heated in a non-transferred arc electric arc heater to an extremely high temperature (e.g., 5,000° C.). The ladle addition is introduced into the heated gas stream which raises the temperature thereof to be about equal to or greater than the melt temperature. The heated gas stream and the entrained ladle addition is then introduced into the ladle. As the gas stream impinges on the melt, the ladle addition inertially separates out and combines with the melt with the resulting off-gas being exhausted from the ladle. The off-gas can be recycled to the arc heater for reuse.

BRIEF DESCRIPTION OF THE DRAWING

For a better understanding of the invention, reference may be made to the embodiments exemplary of the invention shown in the accompanying drawing of a schematic representation of the method embodying the present invention.

DETAILED DESCRIPTION

Referring to the FIGURE, a gas 10 is introduced into the arc heater 12 which is of the non-transferred arc type. U.S. Pat. No. 3,705,975, entitled "Self Stabilizing Arc Heater Apparatus", issued Dec. 12, 1972, is a representative example for the construction of this type of arc heater. The gas 10 can be introduced via line 11 through the axial gap 14 between the upstream electrode 16 and the downstream electrode 18. Gas addition can also take place through a port (not shown) upstream of the upstream electrode 16. The arc heater 12 is energized from the power supply 20 through the conductors 21. The power supply can be single or multiphase A.C. or D.C. The gas 10 is heated by its contact with the electric arc 22 that is generated inside the arc heater 12. The ladle addition 24 is then added to the arc heated gas stream 26 via line 25. Preferably, this occurs downstream of the arc heater 12 as shown. However, where finely-divided materials are used, they can be introduced directly into the arc heater 12 or into the gas line 11 via the line 27 and valve 29. Downstream entry of the ladle addition 24 reduces wear and abrasion that can occur if the material is passed through the arc heater 12. The arc heated gas stream 26 entrains the ladle addition 24 and is then directed into the ladle 30 through a suitable opening 32 provided in the ladle cover 34.

As the arc heated gas stream 26 containing the entrained ladle addition 24 enters the ladle 30, the direction of the gas stream 26 changes as it impinges on the surface 36 of the melt 38. This causes inertial separation of the entrained materials 24 from the gas stream 26. At this point the gas stream 26 having delivered the ladle addition 24 to the melt has completed its function and is now designated as an off-gas 40. An exhaust port 42 is provided in the ladle cover 34 for the passage of the off-gases 40 from the ladle 30. The off-gas 40 can then be recycled back to the arc heater 12 via the off-gas recycle system 44 if desired.

Typically, the arc heater 12 will mount on the ladle cover 34. However, other mounting arrangements can be used. Because the ladle cover 34 is removable, the piping and electrical connections for the arc heater and other components are flexible as indicated at 45. The ladle addition 24 will be stored in a bin or hopper 46 and sent by conventional means such as a gas transport system indicated by the line 25 to the addition point downstream of the arc heater 12. When the gas transport is used, the temperature of the arc heated gas stream will be adjusted to compensate for the volume of cold transport gas that enters the arc heated stream.

In most cases free oxygen in the ladle is undesirable due to the formation of oxides with the melt. In order to preclude oxygen problems, a non-oxidizing gas will be used to blanket the surface of the melt. Preferably, the gas used for the blanket and that of the arc heater is the same. Argon, nitrogen, and helium are gases which can be used for both purposes. Because of its better heat transfer characteristics in the electric arc heater, nitrogen is preferred to argon. Industry practice shows that nitrogen is used prior to aluminum deoxidation. Carbon monoxide is another gas which can be used. Because there is no free oxygen available in the ladle, the carbon monoxide will not combust and will function as a good heat transfer medium.

A comparison example between the method of the present invention and a typical combustion gas system is given in Table 1 for raising the temperature of a 41 metric ton melt of steel 23° C. in 20 minutes. This increment was selected as it represents the temperature drop that occurs for a typical addition of 11.4 Kg of lime (CaO) at ambient temperature (25° C.) to the melt. For these calculations one metric ton equals 1000 kilograms.

TABLE 1

| System: | Arc Heater | Combustion Gas |
|---|---|---|
| Melt Weight: | 41 metric tons | 41 metric tons |
| Melt Temperature: | 1580° C. | 1580° C. |

TABLE 1-continued

| | | |
|---|---|---|
| Lime Addition Temperature Drop: | 23° C. | 23° C. |
| Heat Input Needed: | 819 Kw | 819 Kw |
| Electric Power Required: | 1462 Kw | N/A |
| Gas to Particle Heat Transfer Efficiency: | 70% | 70% |
| Arc Heater Efficiency: | 80% | N/A |
| Combustion Efficiency: | N/A | 100% |
| System Efficiency: | 56% | 29% |
| Gas Volume: | 64.9 $Nm^3$ | 844 $Nm^3$ |
| Gas Type: | $N_2$ | $CH_4$/Air |

N/A = Not Applicable

For these calculations the specific heat of the melt was taken to be 0.1031 cal/gm/°C. The efficiency factor for the arc heater is higher because the fraction of arc heated gas energy available to the material existing at the melt temperature is much greater. As indicated in the Table 1 the volume of gas required for the combustion gas system is substantially greater than that needed for the arc heater method. Because of this decrease in gas volume, the ladle addition represents a greater portion of the total flow into the ladle and will separate more quickly from the gas stream. More effective ladle addition deposition in the melt and less carryover with the off-gas will result.

The form of the ladle addition will affect efficiency. Although a wide range of material sizes can be used with the present invention, smaller size additions receive the heat from the gas stream more quickly. Preferably, the additions are finely divided with a size less than or equal to minus 150 mesh. Because the heated ladle addition is deposited on the melt, heating of the ladle addition is also more efficient than trying to impinge the arc heated gas alone on the surface of the melt. Ladle additions include lime, manganese, iron, chromium or aluminum.

By heating the added materials to a temperature in excess above the melt temperature, the excess heat can balance the heat loss through the walls and from the surface and the loss due to cold gas injected for stirring as well as other heat loss sources. The exact temperature to which the ladle additions are heated is determined by these factors and will vary with each application.

Other embodiments of the invention will be apparent to those skilled in the art from a consideration of the specification or practice of the invention disclosed herein. It is intended that the specification be considered as exemplary only with the true scope and spirit of the invention being indicated by the following claims.

I claim:

1. A method of making particulate additions to a melt contained in a covered ladle without significant loss of melt temperature and characterized by minimization of contact between the particulate additions and the refractories, comprising:

heating a gas stream in a non-transferred plasma arc electric heater to a temperature greater than that of the melt;

introducing the ladle addition into the thus heated gas stream whereby the temperature of the ladle addition is raised to be about equal to or greater than the melt temperature;

introducing the heated gas stream having the heated entrained ladle addition into the ladle with substantially all of the ladle addition separating out of the gas stream as the gas stream impinges on the melt, the gas stream becoming an off gas and the heated ladle addition combining with the melt without substantially reducing the temperature thereof; and exhausting the off gas from the ladle.

2. The method of claim 1 wherein the gas is selected from the group consisting of carbon monoxide, nitrogen, argon, or helium.

3. The method of claim 1 wherein the ladle addition is selected from the group consisting of lime, manganese, iron, chromium, or aluminum.

4. A method of making particulate additions to a melt contained in a covered ladle without significant loss of melt temperature and characterized by minimization of contact between the particulate additions and the refractories, comprising:

heating a gas stream in a non-transferred plasma arc electric heater to a temperature greater than that of the melt;

introducing the ladle addition in a finely divided form into the thus heated gas stream whereby the temperature of the ladle addition is raised to be about equal to or greater than the melt temperature;

introducing the heated gas stream having the heated entrained ladle addition into the ladle with substantially all of the ladle addition separating out of the gas stream as the gas stream impinges on the melt, the gas stream becoming an off gas and the heated ladle addition combining with the melt without substantially reducing the temperature thereof; and exhausting the off gas from the ladle.

5. The method of claim 4 wherein the gas is selected from the group consisting of carbon monoxide, nitrogen, argon, or helium.

6. The method of claim 4 wherein the ladle addition is selected from the group consisting of lime, manganese, iron, chromium, or aluminum.

7. The method of claim 6 wherein the ladle addition has a size of less than or equal to substantially minus 150 mesh.

8. A method of preheating a ladle addition making particulate additions to a melt contained in a ladle enclosed by a removable cover without significant loss of melt temperature and characterized by minimization of contact between the particulate additions and the refractories, comprising:

mounting a non-transferred plasma electric heater on the cover with the outlet of the arc heater being in communication with the interior of the ladle;

introducing a gas stream into the arc heater for heating to a temperature greater than that of the melt;

introducing the ladle addition in a finely divided form into the heated gas stream whereby the temperature of the ladle addition is raised to be about equal to or greater than the melt temperature;

introducing the thus heated gas stream having the heated entrained ladle addition into the ladle with substantially all of the ladle addition separating out of the gas stream as the gas stream impinges on the melt, the gas stream becoming an off gas and the heated ladle addition combining with the melt without substantially reducing the temperature thereof; and exhausting the off gas from the ladle.

9. The method of claim 8 wherein the gas is selected from the group consisting of carbon monoxide, nitrogen, argon, or helium.

10. The method of claim 8 wherein the ladle addition is selected from the group consisting of lime, manganese, iron, chromium, or aluminum.

11. The method of claim 10 wherein the ladle addition has a size of less than or equal to substantially minus 150 mesh.

12. A method of making particulate additions to a melt contained in a ladle enclosed by a removable cover without significant loss of melt temperature and characterized by minimization of contact between the particulate additions and the refractories, comprising:

mounting a non-transferred plasma arc electric heater on the cover with the outlet of the arc heater being in communication with the interior of the ladle;

introducing a gas stream and the ladle addition in a finely-divided form into the arc heater for heating the gas and ladle addition with the ladle addition being entrained with the gas stream whereby the ladle addition and gas stream are raised to a temperature greater than that of the melt;

introducing the thus heated gas stream having the heated entrained ladle addition into the ladle with substantially all of the ladle addition separating out of the gas stream as the gas stream impinges on the melt, the gas stream becoming an off gas and the heated ladle addition combining with the melt without substantially reducing the temperature thereof;

exhausting the off gas from the ladle; and recycling the off gas to the incoming gas stream of the arc heater.

13. The method of claim 12 wherein the gas is selected from the group consisting of carbon monoxide, nitrogen, argon, or helium.

14. The method of claim 12 wherein the ladle addition is selected from the group consisting of lime, manganese, iron, aluminum, or chromium.

15. The method of claim 14 wherein the ladle addition has a size of less than or equal to substantially minus 150 mesh.

* * * * *